US005080222A

United States Patent [19]

McNary

[11] Patent Number: 5,080,222

[45] Date of Patent: Jan. 14, 1992

[54] CHILD RESISTANT MEDICINE BOX

[75] Inventor: Drew McNary, Brewster, N.Y.

[73] Assignee: Tenax Corporation, Danbury, Conn.

[21] Appl. No.: 711,296

[22] Filed: Jun. 6, 1971

[51] Int. Cl.[5] ..... A45C 13/10; B65D 43/12

[52] U.S. Cl. ..... 206/1.5; 206/540; 220/346

[58] Field of Search ..... 206/1.5, 528, 540; 220/345-347, 281

[56] References Cited

U.S. PATENT DOCUMENTS

| | | | |
|---|---|---|---|
| 3,648,831 | 3/1972 | Arnone | 220/345 X |
| 3,749,230 | 7/1973 | Foster . | |
| 3,782,584 | 1/1974 | Swenson et al. . | |
| 3,833,143 | 9/1974 | Starkermann et al. | 220/345 |
| 3,888,350 | 6/1975 | Horvath . | |
| 3,894,655 | 7/1975 | Mattheis et al. . | |
| 3,907,103 | 9/1975 | Shaw . | |
| 3,942,630 | 3/1976 | Phillips . | |
| 3,987,891 | 10/1976 | Horvath . | |
| 4,007,828 | 2/1977 | Mayled . | |
| 4,048,050 | 9/1977 | Hillman . | |
| 4,062,445 | 12/1977 | Möe . | |
| 4,076,117 | 2/1978 | Wisdom et al. . | |
| 4,113,098 | 9/1978 | Howard . | |
| 4,120,400 | 10/1978 | Kotyuk . | |
| 4,126,224 | 11/1978 | Laauwe et al. . | |
| 4,174,034 | 11/1979 | Hoo . | |
| 4,192,422 | 3/1980 | Kotyuk . | |
| 4,284,204 | 8/1981 | Carey, Jr. . | |
| 4,333,567 | 6/1982 | Leonard | 220/345 X |
| 4,342,403 | 8/1982 | Badltke et al. | 220/345 |
| 4,364,488 | 12/1982 | Anjou . | |
| 4,401,210 | 8/1983 | Anjou . | |
| 4,406,362 | 9/1983 | Thomas et al. . | |
| 4,469,241 | 9/1984 | Westphal . | |
| 4,485,915 | 12/1984 | Berghahn . | |
| 4,561,544 | 12/1985 | Reeve . | |
| 4,615,461 | 10/1986 | Liv | 220/345 X |
| 4,844,284 | 7/1989 | Drozd et al. . | |
| 4,898,195 | 2/1990 | Sussman . | |
| 4,946,057 | 8/1990 | Connolly et al. . | |

FOREIGN PATENT DOCUMENTS

| | | | |
|---|---|---|---|
| 456176 | 11/1936 | United Kingdom | 206/540 |
| 655507 | 7/1951 | United Kingdom | 206/540 |
| 1127739 | 9/1968 | United Kingdom | 220/345 |

*Primary Examiner*—Bryon P. Gehman

*Attorney, Agent, or Firm*—Kramer, Brufsky & Cifelli

[57] ABSTRACT

A safety box having a cover slidably receiving a tray. Vertical and horizontal rails are provided on the interior of the sidewalls of the cover which cooperate with laterally extending lugs on the sidewalls of the tray to preclude movement of the tray relative to the cover unless the cover is bowed by utilizing a vertical force to it to flare the vertical rails away from the lugs, enabling the tray to slide relative to the cover without interference of the lugs with the vertical rails. The horizontal rails contact the lugs and retard sliding movement of the tray relative to the cover when the box is opened to keep the tray and cover assembled. Lateral flanges are also provided on the cover for frictional engagement with the bottom of a track on the tray to impede flexing of the cover unless a substantial force is applied to the cover.

6 Claims, 2 Drawing Sheets

CHILD RESISTANT MEDICINE BOX

BACKGROUND OF THE INVENTION

1. Field of the Invention

This invention relates to a box for packaging and marketing drugs which is purposely provided with means to impede opening of the box by a child or infant.

2. Description of the Prior Art

The prior art is replete with devices on boxes to render them child-proof or difficult to operate and open to preclude inadvertent removal of a drug which may be harmful if swallowed by an infant. Examples of such boxes may be found in U.S. Pat. Nos. 3,782,584; 3,888,350; 3,942,630; 4,126,224; and 4,844,284.

U.S. Pat. No. 3,782,584 describes a sliding lid, safety pill box with out-turned wing portions which prevent opening of the box until pressed inward. This patent is exemplary of one well known method for providing a safety latch in such boxes. Detents are depressed inwardly so the cover can be slid relative to a tray. The detents are depressed directly rather than the sides or top of the box being pressed U.S. Pat. No. 3,888,350 pertains to a safety box with a sliding lid which is released when the sides of the box are squeezed together. This patent is exemplary of the socalled "side-squeeze" constructions. Squeezing the sides bows the cover so that a cam or locking detent on the interior of the cover can be overridden by the upper edge of the tray which is normally disposed between the back or depending surface of the cover and the most forward portion of the cam.

The following patents disclose a box which is opened by applying a force downwardly on the cover to override a detent tab lock:

U.S. Pat. No. 3,942,630 is directed to a sliding cover safety box which is released for opening by pressing down on the cover prior to sliding it open.

U.S. Pat. No. 4,126,224 shows a sliding lid, child resistant pill box which is opened by pressing down on the lid and sliding it back.

Both of these patents illustrate constructions wherein by pressing down on the cover a detent tab lock is overridden in an axial, rather than lateral direction. In other words, the cover is flared over and around the detent lock on a tray so that the two can be separated by sliding them apart.

U.S. Pat. No. 4,844,284 is directed to a child resistant box with a sliding lid, the body of the box having two locking tabs which engage recesses in the sidewalls of the top of the box. The locking tabs are released by pressing down onto the box lid causing the sides to flare outward and the sides of the recesses out of engagement with the locking lugs. The detent lugs are also substantially tetrahedron in shape so that upon closing of the box, a cam surface is provided on the lugs, i.e., the rear triangular surface of each lug, enabling the lock to be put back in place by overriding the rail back into the recess when the box is closed. Additionally, an abutment adjacent the front end of the tray is provided for impeding inward deflection of the top wall of the cover member adjacent the front wall of the tray to make it more difficult for an infant or child to release the latching members and open the tray by biting down on the package at the front end thereof.

SUMMARY OF THE INVENTION

In this invention, opening of the box is impeded by a friction flange on the cover seated beneath a track on a relatively slidable tray for receiving drugs or pills. Further, locking detents are provided, but rather than being disposed in grooves until they are flared outwardly relative to the sidewalls of the tray, they are seated behind a vertical rail on the interior of each sidewall of the cover. An enlarged horizontal rail extending for the entire length of the box is provided for effecting frictional contact with the lugs to retard the opening of the box, upon depressing the cover to flare the vertical rails laterally relative to the detent lugs. A perpendicular and horizontal rail system is thus provided on the cover which does away with the necessity for grooves for seating the detent lugs and utilizes less material, rendering the molding of the interior of the cover much easier as well.

In summary, the present invention uses perpendicular and horizontal rails in conjunction with locking lugs or detents rather than grooves in a sidewall of a cover for the tray and incorporates the additional feature of an inwardly extending flange on the cover in frictional contact with a track on the tray, making it much more difficult to bow the cover to override the lock provided by the rail against a detent lug on the sidewall of the tray.

BRIEF DESCRIPTION OF THE DRAWINGS

Further objects and advantages of the invention will become more apparent from the following description and claims, and from the accompanying drawings, wherein:

DETAILED DESCRIPTION OF THE PREFERRED EMBODIMENT

Figures 1, 2, 3:
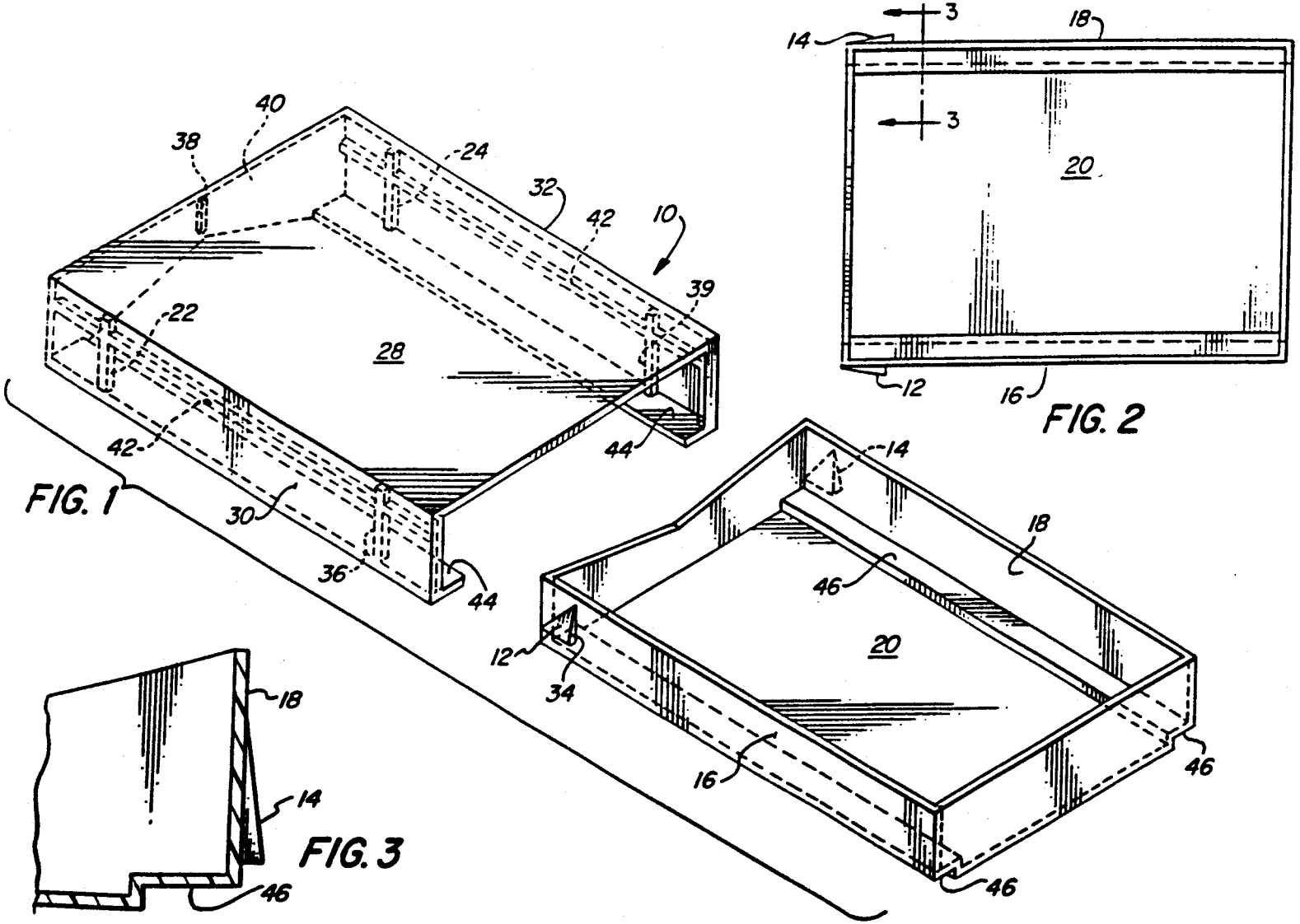
FIG. 1 is an exploded perspective view of the box components of the present invention.
FIG. 2 is a top plan view of the tray portion of the box shown in FIG. 1.
FIG. 3 is a cross-sectional view of a corner of the tray taken substantially along the plane indicated by line 3—3 of FIG. 2.
Figure 6:
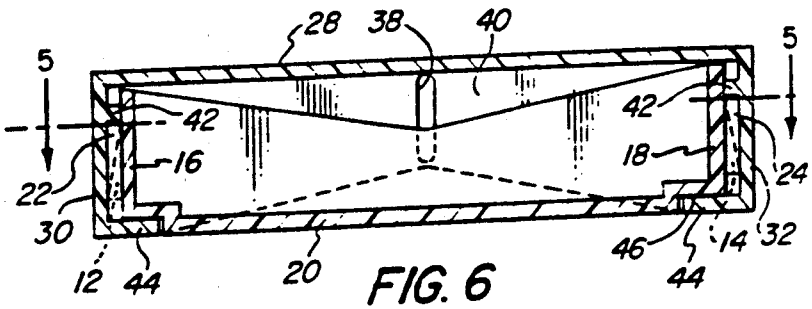
FIG. 6 is a cross-sectional view taken substantially along the plane indicated by line 6—6 of FIG. 5.

Referring now to the drawings in detail wherein like numerals indicate like elements throughout the several views, the box 10 has a pair of tetrahedron shaped detents, lugs, or tabs 12,14 — one of the tabs 12,14 is disposed on each of the sides 16,18 of the tray portion 20 of the box, at the back, and engage a surface of a perpendicular or vertical stop rails 22,24, respectively, formed by molding on the sidewalls 30,32, respectively, of box top 28 to prevent opening of the box unless properly manipulated.

To open the box 10, the top 28 is pressed down (as in FIG. 7), causing the sides 30,32 of the box top 28 to flare outwardly, allowing the tray portion 20 of the box 10 to be slid outwardly relative to the cover 28. By flaring the sides 30,32 of the cover 28 outwardly upon depressing the top of the cover, the front planar surface 34 of each of the tetrahedron detents tabs or lugs 12,14 is shifted laterally inwardly (the rails being flared outwardly) relative to the perpendicular rails 22,24 so the detents or lugs 12,14 can pass the rails 22,24 when the tray 20 is pulled linearly outward from the cover 28.

Figure 7:
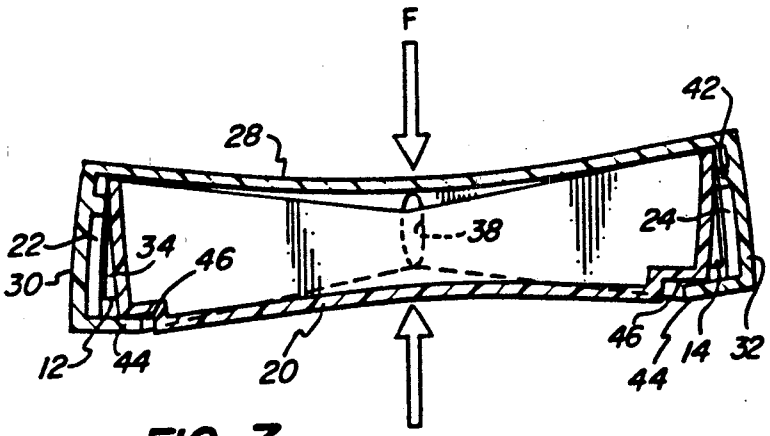
FIG. 7 is a view similar to FIG. 6, but illustrating the manner of flaring the cover to unlock the tray so it can be slid open relative to the cover.
Figure 4:
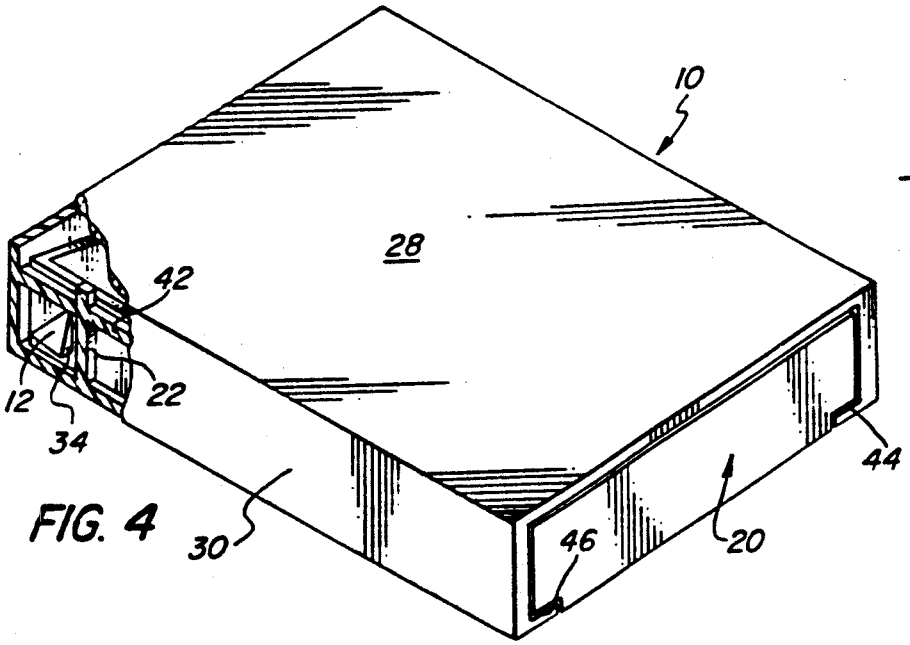
FIG. 4 is a perspective view of the assembled box components illustrated in FIG. 1 with a corner thereof broken away and shown in section to illustrate the locking mechanism preventing the tray from being slid relative to the cover.
Figure 5:
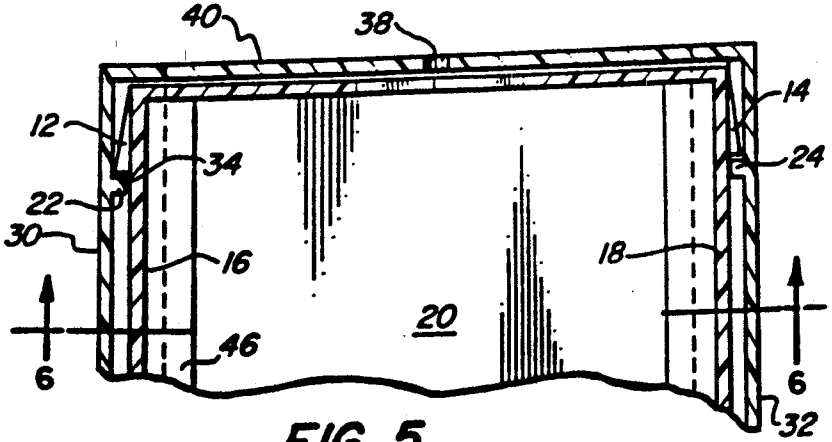
FIG. 5 is a partial longitudinal cross-sectional view through the assembled box components of FIG. 4 as would be seen along the plane indicated by line 5—5 of FIG. 6.

A second perpendicular rail 36,39 is provided on each of the sides of box top 28 to limit complete disassociation or removal of the tray 20 from the top 28 by engaging the planar surface 34 of the tetrahedron detents 12,14. A slit 38 is provided on the rear surface 40 of the cover 28 to enable bowing of the cover, as indicated in FIG. 7 of the attached drawings, so as to ease the flaring of the rails 22,24 and move them laterally outwardly relative to the tetrahedron detents or lugs 12,14 on the tray portion 20 of the box 10.

A horizontal rail 42 is also provided along each sidewall 30,32 of the cover 28 for the length of the sidewall. Each of the horizontal rails 42 extend between the pairs of vertical rails 22,36 and 24,39 and the single horizonal rail and the two depending vertical rails are easily molded on the sidewalls of the cover. The horizontal rails 42 contact one of the triangular surfaces of the tetrahedron detents or lugs 12,14 once the tray 20 is pulled out relative to the cover 28 to provide a friction brake on the disassociation of the tray from the cover so it is not inadvertently pulled out too far before the contents are removed from the tray.

The cover sidewalls 30,32 also include an inwardly extending flange 44 which rides along and beneath a corresponding track 46 on the tray 20. This arrangement makes it difficult for a child to manually override the cover lock by flaring or bowing the cover 28 in that a large amount of force must be applied to the cover 28 to bow it sufficiently so the rail ands detents are in separated planes. This is due to the frictional engagement of the inwardly extending flange 44 with the bottom of track 46 during the entire time that a force F is applied to the cover to assure that there is a drag coefficient between the track 46 and flange 44, even as the detents override each of the rails.

Upon closing of the box by pushing the tray 16 into cover 28, the outwardly projecting, outer triangular surface of each detent or lug 12,14 will cam the cover sides outwardly, permitting the surface 34 on each detent or lug to snap behind the corresponding rail 22,24 to return the box 10 to a locked condition.

What is claimed as new is:

1. A box comprising:

a tray having a pair of upright sidewalls; a front wall and a rear wall connected to a bottom wall, a lug extending laterally outwardly from each of said upright sidewalls, a cover adapted to close said tray and receive said tray in sliding engagement therewith, said cover having a top wall, a cover sidewall depending from each of two opposed edges of said top wall, and a rear wall connected to said top wall, and a vertical rail formed on the interior of each sidewall depending from said top wall for interfering engagement with a surface of a lug on each of said upright sidewalls to lock said tray against sliding movement relative to said cover;

said cover being flexible so as to be capable of being depressed to flare the cover sidewalls thereof relative to said tray in order to bypass the interfering engagement of each of said lugs with said vertical rail on each of the sidewalls of said cover so said tray may be slid relative to said cover, including another vertical rail formed on the interior of each of said sidewalls of said cover in spaced parallel relation to the first vertical rail on the interior of each sidewall of said cover to preclude complete disassembly of said tray and cover.

2. The box of claim 1, wherein:

each of said cover sidewalls includes a flange connected thereto extending towards each other beneath said bottom wall; and said bottom wall has a track formed therein between said bottom wall and each of the upright sidewalls in frictional contact with a flange on one of said cover sidewalls to impede flexing of said cover.

3. The box of claim 1, including:

a horizontal rail on each of the sidewalls of said cover intersecting said vertical rails thereon for contacting in frictional engagement one of the sidewalls of said tray to retard sliding movement between said tray and cover.

4. The box of claim 1 wherein each said lug has a tetrahedron shape, a flat surface of each lug abutting a said first vertical rail on said cover and an adjacent triangular surface providing a cam surface enabling said cover to flex outwardly upon contact therewith to reestablish said interfering engagement with said first vertical rail upon reassembly of said tray and cover upon sliding said tray into said cover.

5. The box of claim 1 wherein the rear wall of said cover includes a slit formed therein to aid flexure of said cover upon a depressing force being applied thereto.

6. A box comprising:

a tray having a pair of upright sidewalls; a front wall and a rear wall connected to a bottom wall, a lug extending laterally outwardly from each of said upright sidewalls, a cover adapted to close said tray and receive said tray in sliding engagement therewith, said cover having a top wall, a cover sidewall depending from each of two opposed edges of said top wall, and a rear wall connected to said top wall, and a rail formed on the interior of each cover sidewall depending from said top wall for interfering engagement with a surface of a lug on each of said upright sidewalls to lock said tray against sliding movement relative to said cover;

said cover being flexible so as to be capable of being depressed to flare the sidewalls thereof relative to said tray in order to bypass the interfering engagement of each said lug with said rail on each of the sidewalls of said cover to said tray may be slid relative to said cover;

another rail formed on the interior of each of said sidewalls of said cover in spaced parallel relation to the first said rail on the interior of each sidewall of said cover to preclude complete disassembly of said tray and cover;

each of said cover sidewalls includes a flange connected thereto extending towards each other beneath said bottom wall; and said bottom wall has a track formed therein between said bottom wall and each of the upright sidewalls in frictional contact with a flange on one of said cover sidewalls to impede flexing of said cover.

* * * * *

UNITED STATES PATENT AND TRADEMARK OFFICE

CERTIFICATE OF CORRECTION

PATENT NO. : 5,080,222

DATED : January 14, 1992

INVENTOR(S) : Drew McNary

It is certified that error appears in the above-identified patent and that said Letters Patent is hereby corrected as shown below:

Title page, item

"[22] Filed: Jun. 6, 1971" should be

--[22] Filed: Jun. 6, 1991--.

Signed and Sealed this

Twenty-second Day of June, 1993

*Attest:*

Michael K. Kirk

MICHAEL K. KIRK

*Attesting Officer*

*Acting Commissioner of Patents and Trademarks*